US006050042A

United States Patent [19]

Durachko

[11] Patent Number: 6,050,042

[45] Date of Patent: Apr. 18, 2000

[54] SHINGLE ROLL SYSTEM

[76] Inventor: James Durachko, 337 Fancy Hill Rd., Boyertown, Pa. 19512

[21] Appl. No.: 09/106,416

[22] Filed: Jun. 29, 1998

Related U.S. Application Data

[63] Continuation-in-part of application No. 08/686,826, Jul. 22, 1996, abandoned.

[51] Int. Cl.[7] ..... E04D 1/26

[52] U.S. Cl. ..... 52/557; 52/314; 52/555

[58] Field of Search ..... 52/314, 554, 555, 52/557; D25/139, 140

[56] References Cited

U.S. PATENT DOCUMENTS

| | | | |
|---|---|---|---|
| 1,398,250 | 11/1921 | Yetter | 52/557 |
| 2,113,644 | 4/1938 | Bollaert | 52/557 |
| 4,571,356 | 2/1986 | White, Sr. et al. | 428/143 |
| 4,850,304 | 7/1989 | Nicholson | 118/694 |
| 5,037,685 | 8/1991 | Richards et al. | 52/518 |
| 5,050,357 | 9/1991 | Lawson | 52/314 |
| 5,369,929 | 12/1994 | Weaver et al. | 52/557 |

*Primary Examiner*—Michael Safayi

[57] ABSTRACT

A shingle roll system for shingling a roof structure quickly and easily. The system includes an elongate shingle sheet having top and bottom surfaces, a pair of opposite end edges and a pair of side edges extending between the end edges of the shingle sheet. The shingle sheet has a dividing line extending between the end edges of the shingle sheet which divides the shingle sheet into exposed and coverage portions. The exposed portion has a width about five-sixths the width of the coverage portion.

1 Claim, 2 Drawing Sheets

SHINGLE ROLL SYSTEM

CROSS REFERENCE TO RELATED APPLICATION

This application is a continuation-in-part of my prior utility patent application Ser. No. 08/686,826, filed Jul. 22, 1996 now abandoned.

BACKGROUND OF THE INVENTION

1. Field of the Invention

The present invention relates to shingle systems and more particularly pertains to a new shingle roll system for shingling a roof structure quickly and easily.

2. Description of the Prior Art

The use of shingle systems is known in the prior art. More specifically, shingle systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,919,823; U.S. Pat. No. 5,375,491; U.S. Pat. No. Des. 350,615; U.S. Pat. No. 4,587,785; U.S. Pat. No. 3,973,369; U.S. Pat. No. 3,903,340; U.S. Pat. No. 1,444,550; U.S. Pat. No. 2,182,526; U.S. Pat. No. 5,050,357; U.S. Pat. No. 4,470,237; U.S. Pat. No. 1,856,717; U.S. Pat. No. 1,978,841; and U.S. Pat. No. 3,395,789.

Traditional asphalt shingles come in strips 30 about 36 inches long and about 12 inches wide. Two 5-inch deep slots, or cutouts 31,32, are divide each strip 30 of traditional asphalt shingle into three 12 inch by 12 inch sections, or tabs. Most come with dabs of adhesive 21 across each strip 30 just above the cutout tops. When the adhesive 21 is softened by the heat of the sun, it seals the tabs of overlapping shingles against strong winds and heat caused curing.

Each traditional shingle strip 30 is fastened to a roof structure with four fasteners (usually nails) extended through the strip 30 in a line just above the tops of the cutouts 31,32 with one nail above each of the cutouts 31,32 and one nail adjacent each end edge of the strip 30. Traditional asphalt shingles are best laid on a roof structure with three overlapping strips 30. This provides an actual coverage width of about 2 inches over the roof (as indicated in FIG. 4 with the symbol "β") for each strip 30 of traditional shingle because of the cutouts 31,32 in the strip 30 and the joints formed between adjacent strips 30 of traditional asphalt shingles. For low pitched roof structures, 2 inches of actual coverage is not enough protection from the elements and typically more layers of strips 30 are used (such as five layers) to increase the actual coverage of the strips 30 (to about 3 inches of actual coverage). This adds a significant amount of weight of the shingles on the roof structure which may not be practical for weaker roof structures. It also leads to a greater amount of work and time installing the shingles because now a user has to install four layers of strip 30s instead of three layers. Further, the amount of shingles used in four layers increases the material costs because of the additional strips 30 of shingles needed for covering the roof structure.

SUMMARY OF THE INVENTION

In view of the foregoing disadvantages inherent in the known types of shingle systems now present in the prior art, the present invention provides a new shingle roll system construction wherein the same can be utilized for shingling a roof structure quickly and easily.

The general purpose of the present invention, which will be described subsequently in greater detail, is to provide a new shingle roll system apparatus and method which has many of the advantages of the shingle systems mentioned heretofore and many novel features that result in a new shingle roll system which is not anticipated, rendered obvious, suggested, or even implied by any of the prior art shingle systems, either alone or in any combination thereof.

To attain this, the present invention generally comprises an elongate shingle sheet having top and bottom surfaces, a pair of opposite end edges and a pair of side edges extending between the end edges of the shingle sheet. The shingle sheet has a dividing line extending between the end edges of the shingle sheet which divides the shingle sheet into exposed and coverage portions. The exposed portion has a width about fifth-sixths the width of the coverage portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shingle roll system apparatus and method which has many of the advantages of the shingle systems mentioned heretofore and many novel features that result in a new shingle roll system which is not anticipated, rendered obvious, suggested, or even implied by any of the prior art shingle systems, either alone or in any combination thereof.

It is another object of the present invention to provide a new shingle roll system which may be easily and efficiently manufactured and marketed.

It is a further object of the present invention to provide a new shingle roll system which is of a durable and reliable construction.

An even further object of the present invention is to provide a new shingle roll system which is susceptible of a low cost of manufacture with regard to both materials and labor, and which accordingly is then susceptible of low prices of sale to the consuming public, thereby making such shingle roll system economically available to the buying public.

Still yet another object of the present invention is to provide a new shingle roll system which provides in the apparatuses and methods of the prior art some of the advantages thereof, while simultaneously overcoming some of the disadvantages normally associated therewith.

Still another object of the present invention is to provide a new shingle roll system for shingling a roof structure quickly and easily.

Yet another object of the present invention is to provide a new shingle roll system which includes an elongate shingle sheet having top and bottom surfaces, a pair of opposite end edges and a pair of side edges extending between the end edges of the shingle sheet. The shingle sheet has a dividing line extending between the end edges of the shingle sheet which divides the shingle sheet into exposed and coverage portions. The exposed portion has a width about fifth-sixths the width of the coverage portion.

Still yet another object of the present invention is to provide a new shingle roll system that can be used to cover a roof structure with a reduced amount of materials than with traditional asphalt shingles and also in a significantly less amount of time than traditional asphalt shingles.

Even still another object of the present invention is to provide a new shingle roll system that provides significantly more actual coverage to a roof structure than is achieved with traditional asphalt shingles of a comparable width.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
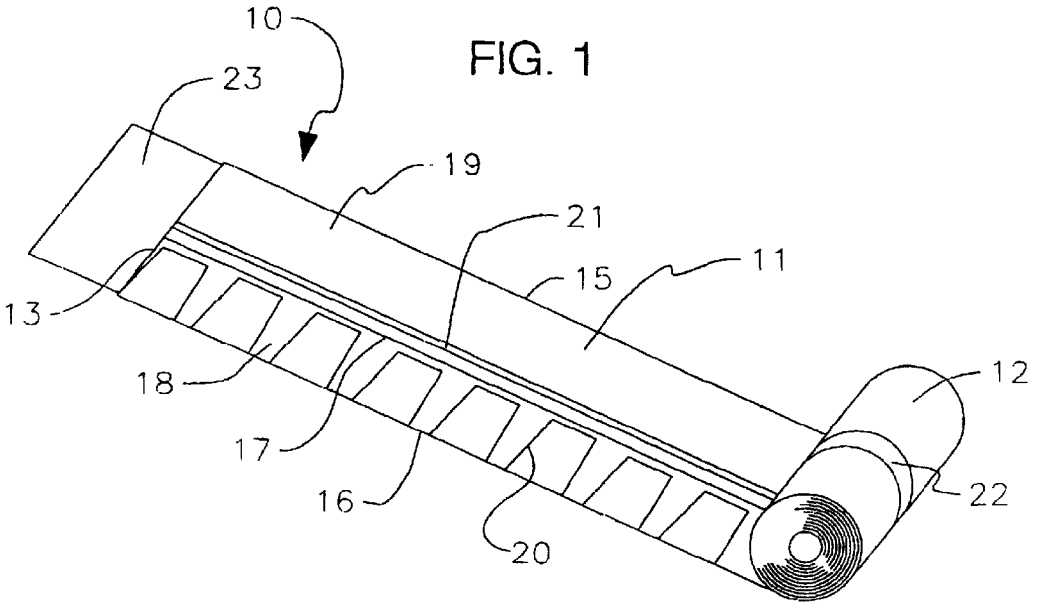
FIG. 1 is a schematic perspective view of a rolled shingle sheet of a new shingle roll system according to the present invention.
Figure 2:
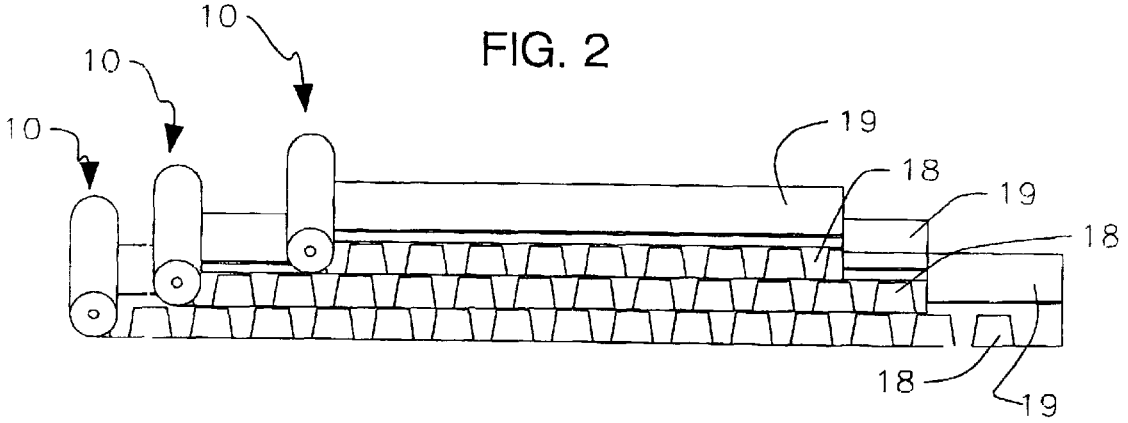
FIG. 2 is a schematic top plan view of the present invention in use showing the positioning of overlapping shingle sheets on a roof structure.
Figure 3:
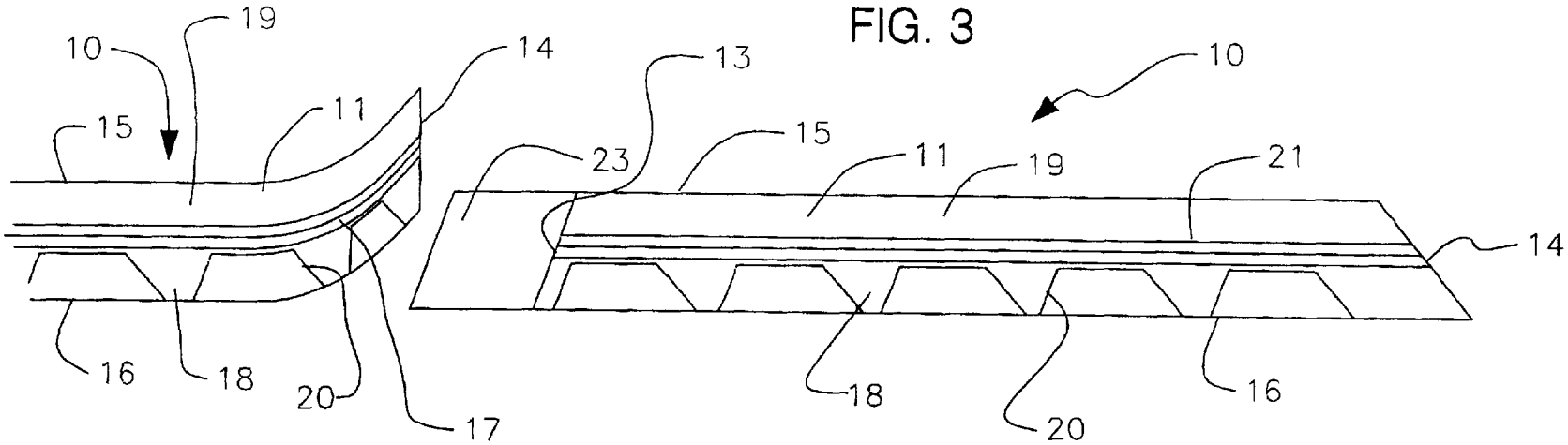
FIG. 3 is a schematic perspective view of the present invention illustrating the splicing sheet.

With reference now to the drawings, and in particular to FIGS. 1 through 4 thereof, a new shingle roll system embodying the principles and concepts of the present invention will be described.

As best illustrated in FIGS. 1 through 4, the shingle roll system generally comprises an elongate shingle sheet 10 having top and bottom surfaces 11,12, a pair of opposite end edges 13,14 and a pair of side edges 15,16 extending between the end edges 13,14 of the shingle sheet 10. The shingle sheet 10 has a dividing line 17 extending between the end edges 13,14 of the shingle sheet 10 which divides the shingle sheet 10 into exposed and coverage portions 18,19. The exposed portion 18 has a width about five-sixths the width of the coverage portion 19.

The shingle system is designed for quickly shingling a roof structure. In closer detail, elongate shingle sheet 10 has generally flat top and bottom surfaces 11,12, a pair of generally straight opposite end edges 13,14 and a pair of generally straight elongate side edges 15,16 extending between the end edges 13,14 of the shingle sheet 10. The end edges 13,14 of the shingle sheet 10 is extended generally parallel to one another. The side edges 15,16 of the shingle sheet 10 are extended generally parallel to one another and generally perpendicular to the end edges 13,14 of the shingle sheet 10. The shingle sheet 10 has a length defined between the end edges 13,14 of the shingle sheet 10. The shingle sheet 10 has a width defined between the side edges 15,16 of the sheet.

The shingle sheet 10 preferably comprises a flexible material sufficiently flexible to permit rolling of the shingle sheet 10 along the length of the sheet into a roll preferably about a cylindrical tube or dowel so that the roll of the shingle sheet 10 may be rested on a side of the roll formed by one of the side edges 15,16 of the shingle sheet 10. Ideally, the shingle sheet 10 comprises a fiberglass embedded asphalt such as used in traditional fiberglass embedded shingles. Examples of ideal illustrative lengths of the shingle sheet include 80 feet, 60 feet and 48 feet lengths which are ideal to cover the entire width of most roof structures. Ideally, the width of the shingle sheet 10 is about 11 inches, which is 1 inch shorter than traditional shingles strips 30 which are 12 inches thus resulting in a reduction of about 8⅓% of the raw materials used to manufacture the shingle system when compared to the amount of raw materials used in a traditional 12 inch wide shingles strips 30, without has to use a splicing sheet 23.

Figure 4:
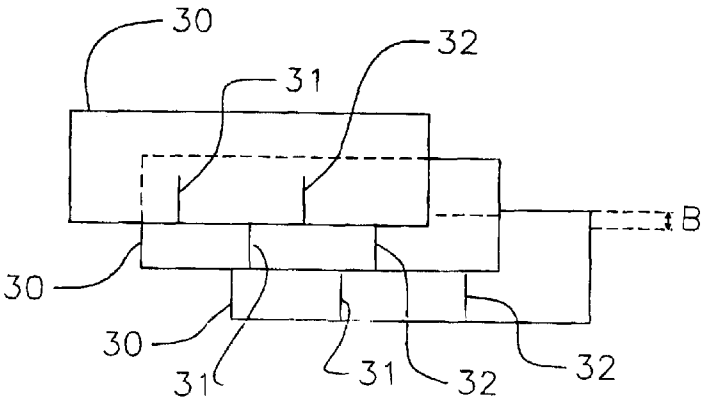
FIG. 4 PRIOR ART
FIG. 4 is a schematic top plan view of traditional asphalt shingle strips.

The shingle sheet 10 has a dividing line 17 extending between the end edges 13,14 of the shingle sheet 10. The dividing line 17 is positioned between the side edges 15,16 of the shingle sheet 10 and has a length extending generally parallel to the side edges 15,16 of the shingle sheet 10. The dividing line 17 divides the shingle sheet 10 into generally rectangular exposed and coverage portions 18,19. The exposed and coverage portions 18,19 each have a length extending between the end edges 13,14 of the shingle sheet 10. The exposed portion 18 has a width defined between one of the side edges 16 of the shingle sheet 10 and dividing line 17. The coverage portion 19 has a width defined between another of the side edges 15 of the shingle sheet 10 and dividing line 17. The width of the exposed portion 18 is preferably about five-sixths the width of the coverage portion 19. Ideally, the width of the exposed portion 18 is about 5 inches and the width of the coverage portion 19 is about 6 inches such that the actual coverage (about 6 inches) provided by the shingle system (indicated in FIG. 2 as "$\alpha$") is three times the actual coverage provided by traditional 12 inch asphalt shingles which have only an actual coverage of about 2 inches (as indicated in FIG. 4 with "$\beta$") Optionally, the width of the coverage portion 19 may be 5 inches if the user desires only two overlapping layers of shingle coverage on a roof for reasons of cost or weight reduction. However, the 6 inch width of the coverage portion is needed to maintain three overlapping layers of shingle coverage on the roof structure.

Preferably, the top surface 11 of the shingle sheet 10 has a design pattern 20 formed to resemble traditional asphalt shingles provided on the exposed portion 18 of the shingle sheet 10 and arranged in a row extending between the end edges 13,14 of the shingle sheet 10.

An adhesive 21 is preferably provided on the top surface 11 of the shingle sheet 10 in a strip extending between the end edges 13,14 of the shingle sheet 10. The strip of adhesive 21 may be continuous or alternately a discontinuous or broken. The strip of the adhesive 21 is positioned on the coverage portion 19 of the shingle sheet 10 towards the dividing line 17 with the length of the strip of adhesive 21 extending generally parallel to the length of the dividing line 17 and the side edges 15,16 of the shingle strip. The strip of the adhesive 21 is designed for providing a seal between the top surface 11 of the shingle sheet 10 and the bottom surface 12 of another shingle sheet placed on top to seal against strong winds and any heat-caused curling of the shingle sheet 10. In use, fasteners used to secure the shingle sheet 10 to the roof structure are to be extended through the shingle sheet 10 between the strip of the adhesive 21 and the dividing line 17.

An elongate protective strip 22 is preferably provided on the bottom surface 12 of the shingle sheet 10. The protective strip 22 has a length extending between the end edges 13,14 of the shingle sheet 10. The protective strip 22 is positioned on the coverage portion 19 of the shingle sheet 10 towards the dividing line 17 at a location corresponding to the location of the strip of the adhesive 21 such that the protective strip 22 comes into contact with the strip of adhesive 21 when the shingle sheet 10 is rolled into a roll along the length of the shingle sheet 10. Like the strip of adhesive, the length of the protective strip 22 is extended generally parallel to the length of the dividing line 17 and the side edges 15,16 of the shingle strip. The strip of adhesive 21 and the protective strip 22 preferably each have generally equal widths. The protective strip 22 preferably comprises a material (such as a type of cellophane) which the adhesive 21 is easily removable such that the adhesive 21 easily detaches from the protective strip 22 when the roll of the shingle sheet 10 is unrolled.

Preferably, a generally rectangular splicing sheet 23 may be coupled to the bottom surface 12 of the shingle sheet 10 adjacent one of the end edges 13 of the shingle sheet 10. Ideally, the splicing sheet 23 is generally fused to the bottom surface 12 of the shingle sheet 10. The splicing sheet 23 has a portion outwardly extending away from the one end edge 13 of the shingle sheet 10. Ideally, the length of the extended portion of the splicing sheet 23 defined between the one end edge and the free edge of the splicing sheet 23 is about 6 inches and the overall length of the splicing sheet 23 is about 12 inches. Ideally, the width of the splicing sheet 23 defined between the side edges 15,16 of the shingle sheet 10 is about equal to the width of the shingle sheet 10.

In use, a roll of the shingle sheet is placed on a roof structure and easily unrolled so that the bottom surface is positioned against the roof structure. Then the user extends fasteners such as nails through the shingle sheet between the dividing line and the strip of adhesive in a spaced apart row extending between the end edges of said shingle sheet. If a nail gun is used, the extending of a sufficient number fasteners along the entire length of the shingle sheet to secure the shingle strip to the roof structure can be completed in less than a minute on a shingle sheet having a length of 48 feet. Another shingle sheet may then be rolled out on the roof structure so that it overlaps with the first shingle sheet. This next shingle sheet is then fastened to the roof structure in the same manner as the first shingle sheet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shingle system for shingling a roof structure, said shingle system comprising:

an elongate shingle sheet having generally flat top and bottom surfaces, a pair of generally straight opposite end edges and a pair of generally straight elongate side edges extending between said end edges of said shingle sheet;

said side edges of said shingle sheet being extended generally parallel to one another, said end edges of said shingle sheet being extended generally parallel to one another, said side edges of said shingle sheet being extended generally perpendicular to said end edges of said shingle sheet;

said shingle sheet having a length defined between said end edges of said shingle sheet;

said shingle sheet comprising a flexible material sufficiently flexible to permit rolling of said shingle sheet along said length of said sheet into a roll;

said shingle sheet comprising fiberglass embedded asphalt;

said shingle sheet having a width defined between said side edges of said sheet, wherein said width of said shingle sheet is about 11 inches;

said shingle sheet having a dividing line extending between said end edges of said shingle sheet, said dividing line being positioned between said side edges of said shingle sheet, said dividing line having a length extended generally parallel to said side edges of said shingle sheet;

said dividing line dividing said shingle sheet into generally rectangular exposed and coverage portions, said exposed and coverage portions each having a length extending between said end edges of said shingle sheet;

said exposed portion having a width defined between one of said side edges of said shingle sheet and dividing line, said coverage portion having a width defined between another of said side edges of said shingle sheet and dividing line, said width of said exposed portion being about five-sixths said width of said coverage portion, wherein said width of said exposed portion is about 5 inches and said width of said coverage portion is about 6 inches;

said top surface of said shingle sheet having a design pattern being provided on said exposed portion of said shingle sheet;

an adhesive being provided on said top surface of said shingle sheet in a strip extending between said end edges of said shingle sheet said strip of said adhesive being positioned on said coverage portion of said shingle sheet towards said dividing line, said strip of adhesive having a length extending generally parallel to said length of said dividing line, wherein fasteners are extended through the shingle sheet between the strip of adhesive and the dividing line to secure the shingle sheet to the roof structure;

an elongate protective strip constructed from cellophane being provided on said bottom surface of said shingle sheet, said protective strip having a length extending between said end edges of said shingle sheet, said protective strips positioned on said coverage portion of said shingle sheet towards said dividing line at a location corresponding to the location of said strip of said adhesive such that said protective strip comes into contact with said strip of adhesive when said shingle sheet is rolled into a roll along said length of said shingle sheet, said length of said protective strip being extended generally parallel to said length of said dividing line, said strip of adhesive and said protective strip each having generally equal widths; and a generally rectangular splicing sheet of a length of about 12 inches being coupled to said bottom surface of said shingle sheet adjacent one of said end edges of said shingle sheet, wherein said splicing sheet is generally fused to the bottom surface of the shingle sheet, said splicing sheet having a portion outwardly extending away from said one end edge of said shingle sheet adapted for positioning underneath the bottom surface of another adjacent shingle sheet, wherein a length of said portion of said splicing sheet is defined between one of said one end edge of said shingle sheet and a free edge of said splicing sheet and is equal to about 6 inches, wherein a width of said splicing sheet is defined between said side edges of said splicing sheet and is about equal to said width of said shingle sheet.

* * * * *